United States Patent [19]

Tihany

[11] Patent Number: 4,771,722

[45] Date of Patent: Sep. 20, 1988

[54] FLOATABLE WATERCRAFT WITH STABILIZING FRAME

[76] Inventor: Laszlo Tihany, 2051 E. Cedar, Tempe, Ariz. 85281

[21] Appl. No.: 901,893

[22] Filed: Aug. 28, 1986

[51] Int. Cl.[4] ..... B63B 7/08

[52] U.S. Cl. ..... 114/345; 114/343; 114/363; 441/131; 441/40

[58] Field of Search ..... 441/129–132, 441/35–45; 114/345, 346, 343, 354, 363, 61, 270; 440/6, 105

[56] References Cited

U.S. PATENT DOCUMENTS

| | | | |
|---|---|---|---|
| 1,869,186 | 7/1932 | Davidson | 441/131 |
| 2,253,936 | 8/1941 | Karst | 441/131 |
| 2,929,080 | 3/1960 | Daily | 441/40 |
| 2,958,306 | 11/1960 | Haxton et al. | 441/130 X |
| 3,074,084 | 1/1963 | Bisch | 441/131 |
| 3,694,835 | 10/1972 | Casey et al. | 114/345 |
| 3,696,451 | 10/1972 | Thompson | 114/345 |
| 4,021,873 | 5/1977 | Francois | 114/345 |
| 4,428,617 | 1/1984 | Lawson | 114/363 X |
| 4,528,925 | 7/1985 | Pyburn | 114/343 X |

FOREIGN PATENT DOCUMENTS

| | | | |
|---|---|---|---|
| 809918 | 3/1937 | France | 114/345 |
| 685795 | 3/1965 | Italy | 114/61 |
| 897623 | 1/1982 | U.S.S.R. | 441/35 |
| 878286 | 9/1961 | United Kingdom | 114/345 |

OTHER PUBLICATIONS

Coast Navigation Advertisement.

*Primary Examiner*—Galen L. Barefoot
*Assistant Examiner*—Paul E. Salmon

[57] ABSTRACT

A floatable water craft which includes a first relatively large doughnut-shaped inner tube and a pair of second and third doughnut-shaped inner tubes. The inner tubes are preferably inflated with air although they may be filled with a foam material for adding additional buoyancy thereto. A frame is carried by the large inner tube and the frame includes an elongated longitudinal support member resting on diametrically opposite sides of the inner tube and a lateral cross support having opposite end portions resting on opposite sides of the first inner tube adjacent the longitudinal axis defined by the longitudinal support member. The ends of the lateral cross member hold the outrigger arms and include apparatus for mounting the second and third inner tube thereto for stabilizing the craft as per conventional outrigger devices. The apparatus may include an electric motor driven power drive unit and a steering device therefore. It may also include a radio/cassette player with remote speakers mounted on the second and third inner tubes; one or more devices for positionably housing beverage containers; and a bracket for mounting a cooler containing beverages and the like.

4 Claims, 2 Drawing Sheets

STEREO 11
13
31
32
33
34
35
36
39
41
43
45
47
49
51
55
61
65
67
71
73
75
80
121
123
124
126
128
129
131
149
150
151
19F
19R 31
32
34
36
41
43
45
47
49
51
53
55
56
57
59
61
65
67
81
101
103
105
107
109
111
113
117
121
125
127
129
130
131
135
151

FLOATABLE WATERCRAFT WITH STABILIZING FRAME

BACKGROUND OF THE INVENTION

1. Field of the Invention

This invention relates generally to inflatable and similar floatable water craft, and more particularly to a floatable water craft comprising a central inner tube and a pair of outrigger inner tubes wherein the central inner tube mounts a frame and at least a seat for carrying one or more passengers.

2. Description of the Prior Art

The prior art includes many types of inflatable or floatable tube-type water craft or boat-like apparatus. Most of such apparatus are relatively expensive and are not designed for floating on relatively shallow waters as well as on deep waters.

Few of the prior art systems can be easily modified to include a drive means and steering means for guiding the craft from place to place.

None of the known prior art shows such a craft carrying a radio cassette player with remotely separated speakers. Similarly, few if any contain beverage container receptacles, battery carrying means; and means for carrying picnic baskets or coolers for carrying beverages and the like.

The present invention solves substantially all of the problems or shortcomings of the prior art while avoiding the creation of any new problems.

BRIEF SUMMARY OF THE INVENTION

It is an object of the present invention to provide floatable water craft which includes a large central doughnut-shaped inner tube.

It is still another object of the present invention to provide a floatable water craft which includes a first relatively large doughnut-shaped inner tube and a pair of relatively small inner tubes connected thereto in an outrigger fashion.

It is yet another object of the present invention to provide a relatively large diameter inner tube and a frame means adapted to be carried by the inner tube to support one or two passengers thereon.

It is yet a further object of the present invention to provide a floatable water craft which can include a drive means and a means for steering the drive means for manuevering the craft from place to place.

It is another object of this invention to provide a floatable water craft which includes a radio/tape cassette player in a pair of remote speakers positioned for providing a true stereo sound.

It is still another object of this invention to provide such a water craft having a collapsible seat mounted thereon for holding one or more persons.

The present invention provides a three-inner tube water craft wherein one or more of the inner tubes may be filled with either air or foam material for increasing the buoyancy thereof. A second and third substantially smaller doughnut-shaped inner tube can also be provided for outrigger purposes. The second and third inner tubes are substantially equal in size while the first inner tube is much larger than either the second or third inner tubes.

A frame is operatively disposed upon the top surfaces of the large inner tube and the frame may include a elongated longitudinal support member having a front end portion adapted to rest on the top surface of one end of the first inner tube and a rear end portion adapted to rest on the top surface of the opposite, diametrically opposed side of the first inner tube. Similarly, the cross member used to mount the outriggers is adapted to have at least one portion resting on the top surface of opposite sides of the first inner tube adjacent the rear portion of the elongated support member.

A seat is mounted on the support member and cross member and the seat may be hingedly connected for enabling the seat to in a collapsed position and an open position and a locking bar may be used to lock the back of the seat in the upright or used position.

Furthermore, a bracket is provided at the rear end of the elongated support member for attaching an electric drive motor and provisions may also be made for (1) a radio cassette player unit with a pair of remote speakers; (2) a bracket for holding a picnic basket, a beverage cooler or the like; (3) a tow hitch for pulling the craft out of the water; (4) beverage retaining means for holding cans or bottles of beverage on the frame; and (5) means for carrying a twelve volt battery under the seat or the like.

These and other objects and advantages of the present invention will be more fully understood after reading the detailed description of the preferred embodiment of the present invention, the claims, and the drawings which are briefly described hereinbelow.

DETAILED DESCRIPTION OF THE PREFERRED EMBODIMENT

Figure 1:
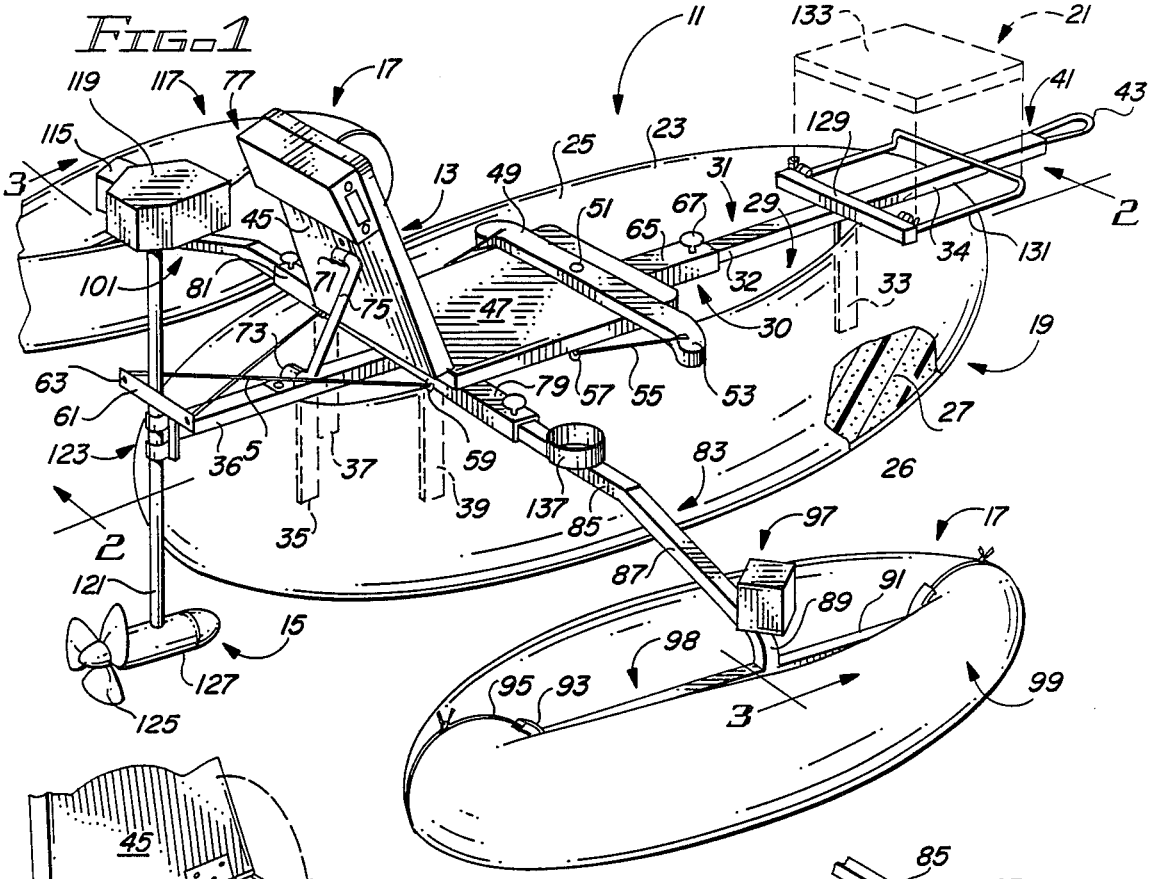
FIG. 1 is a perspective view of a preferred embodiment of the floatable watercraft of the present invention.

FIG. 1 is a perspective view of the floatable watercraft 11 of the present invention. The craft 11 of FIG. 1 is shown as including a seat assembly 13, a motor assembly 15, a side-rigger or outrigger assembly 17, the main body assembly 19 and a cooler carrier assembly 21. The main body assembly 19 includes relatively large doughnut-shaped inner tube 23 having a tube wall 26 with an exterior tube surface 25 and a hollow central interior 27. The hollow central interior 29 may be filled with a gas such as air or may be filled with a foam material such as polyurethane foam to add additional buoyancy or floatability to the inner tube 23. The material of the inner tube may be natural or synthetic rubber or any type of conventional plastic material suited for such a use.

The main body assembly 19 also includes a frame assembly or frame-forming assembly 30. The frame assembly 30 includes a central elongated longitudinal support member 31 having a front end portion 34, an intermediate portion 32, and a rear end portion 36. The front end portion 34 of the elongated support member 31 is positioned on or supported by the top outer surface 25 of the inner tube 23 while the opposite or rear end portion 36 of the elongated support member 31 is positioned on and supported by the top outer surface 25 of the inner tube 23 diametrically opposite that portion of the top surface of the inner tube on which the front portion 34 is disposed.

A downwardly distending front leg member 33 is carried by the elongated support member 31 proximate the junction of the front end portion 34 with the intermediate portion 32 and distends down into the hollow central interior 29 of the inner tube 23. The downwardly distending leg member 33 has its front edge disposed or positioned against the inside surface 25 of the inner tube 23 immediately adjacent the top surface 25 of the inner tube 23 on which the front end portion 34 is disposed. The axis of the distending front leg member 33 is generally perpendicular to the axis of the elongated support member 31.

Similarly, a downwardly distending rear leg member 35 is operatively carried on the lower surface of the elongated support member 31 proximate the junction of the rear end portion 36 and the intermediate portion 32. The rear edge of the downwardly distending rear leg member 35 is disposed snugly against the inside surface 25 of the inner tube 23. Again, the axis of the downwardly distending rear leg member 35 is substantially perpendicular to the longitudinal axis of the elongated support member 31 and generally parallel to the longitudinal axis of the front leg member 33. The distance between the front leg member 33 and the rear leg member 35 is substantially greater than the diameter of the interior 29 of the inner tube 23 so that the inner tube 23 is stretched out and elongated so as to have a central longitudinal axis coincident with the longitudinal axis of the elongated support member 31.

The intermediate portion 32 of the elongated support member 31 includes a lateral cross member 80 having a right end portion 79 and a left end portion 81. The lateral cross member 80 includes a generally rectangular stock member having a hollow interior and the central portion of the cross member 80 is secured to and carried by the elongated support member 31 such that the axis of the lateral cross member 80 is generally perpendicular to the longitudinal axis of the elongated support member 31 and the cross member 80 and elongated support member 31 are generally coplanar.

A second, elongated generally rectangular member 65 having a substantially rectangular hollow interior extends along the mid-portion 32 of the elongated support member 31 and is positioned within the support member 31 being operatively received with the generally rectangular hollow channel of the member 65 with the opposite end or rear end portion 36 extending out of the hollow interior of the member 65 prior to its being disposed on and carried by the top surface of the rear end of the inner tube 23 as previously described.

The seat assembly 13 is positioned on and carried by the generally rectangular, centrally disposed member 65 and the lateral cross support member 80. The seat assembly 13 includes a seat back 45 and a seat bottom 47. Means may be provided on the rear of the seat back 45 for housing or carrying a portable radio/cassette player unit 77 as known in the art. A steering bar 49 is positioned proximate the front of the seat bottom 47 and pivotally mounted to the seat bottom 47 via a pivot pin 51. Since the seat box 47 is carried by the member 65, the seat can be positioned longitudinally along the central portion 32 of the elongated support member 31 and can be moved in a forward or rearward direction along the axis of the support member 31 as desired. When positioned as desired, the wing bolt or fastener device 67 can be tightened to engage the mid portion 32 of the elongated support member 31 and lock the seat assembly 13 in the desired position along the axis of the support member 31. The outside ends of the support member 41 may include apertures through with flexible members such as a cord, string, rope, cable, or the like is inserted and tied. The cable 55 is then erected under the bottom of the seat 47 through a first guide loop 57 and thence through a rear guide loop 59 to a steering bar 61 as hereinafter described. Similarly, the opposite or left hand end portion of the steering bar 49 is connected through a similar cable 55 which extends through first and second guide members 57 and 59, respectively and attaches to the opposite end of the bar member 61 as hereinafter described.

The lateral cross member 80 includes a right, downwardly distending leg member 39 and a left downwardly distending leg member 37. The leg members are carried by the lateral cross member 80 and the axis of the leg members 39 and 37 are generally perpendicular to the axis of the lateral cross member 80 and parallel to the axis of the front and rear downwardly distending leg members 33 and 35, respectively. The left outer surface of the leg member 37 which is disposed into the hollow interior 29 of the inner tube 23 bears against the inside surface 25 of the inner tube 23 while the outside surface of the right leg member 39 bears against the surface 25 of the inner tube 23 directly opposite the left member. The leg members 37 and 39 are disposed under the rear portion of the seat 47 and carried by the cross bar 80 within the hollow interior 29 of the doughnut-shaped inner tube 23 for exerting lateral outward pressure against the inside surfaces 25 of the inner tube 23. The rear or back of the seat back 45 includes a first socket-like bracket 71 while a similar socket-like bracket 73 is connected to the top surface of the rear end portion 36 of the elongated support member 31. A generally elongated, squared, C-shaped locking member 75 having an elongated bight portion and relatively short leg members is adapted to have one leg member inserted into the socket portion of the bracket 71 and the opposite leg member inserted into the socket of the bracket 73 such that the elongated member 75 fixedly secures the back 45 of the seat assembly 13 in an upright position and locks it in that position during use. The member 75 can be pulled out of the sockets 71 and 73 so that the seat can be folded down as hereinafter described for storage and/or transport purposes.

The outrigger assembly 17 includes a right outrigger arm 83 having a first generally horizontal, rectangular member 85 having one end portion adapted to be operatively received within the hollow rectangular channel of the right end portion 79 of the lateral cross member 80 while the opposite end of the horizontal member or portion 85 is integral with a downwardly distending or sloping intermediate portion 87 which terminates in a relatively short vertically disposed end portion 89. The end of end portion 89 is integral with the elongated outrigger support member 98 having a longitudinal axis and a pair of outwardly disposed C-shaped members 93 at opposite distal ends thereof. The bight of the outwardly disposed C-shaped members 93 is adapted to conform to and receive therein the rounded surface 25 of the inner tube 23 within the hollow central portion 29 thereof. A tie member, cord, or cable 95 extends about the curved surface of the end portions 93 and around the corresponding exterior surface 25 of the inner tube 99 so that the inner tube is connected to the end members 93 at diametrically opposite sides of the interior 29 of the inner tube 99. The length of the member 98 is such that the inner tube 99 are stretched longitudinally so as to have a defined axis coincident with the longitudinal axis of the member 98. The axis of the member 98 is generally perpendicular to the axis of the outrigger arm member 83 and either the arm member 83 or the longitudinal member 98 can be adapted to carry a remote speaker 97 connected to the radio/cassette player 77 mounted on the rear of the seat back 45.

As previously described, the relatively smaller outrigger inner tubes 99 and 117 are conventionally made of natural or synthetic rubber, although any suitable plastic material could also be used. The hollow interior of the outrigger inner tubes 99 and 117 are adapted to be filled with a gas such as air, but they can alternatively be filled with a foam material such as polyurethane foam, as previously described for added buoyancy. As shown in FIG. 1, the top surface of the horizontal portion 85 of the outrigger assembly 83 can include a retainer apparatus 137 for holding a beverage container therein while preventing its tipping over while spilling. The left outrigger arm assembly 17 is similar to the right outrigger assembly 17 and includes similar parts including a doughnut-shaped inner tube 117 and a left outrigger arm 101. The size of the right outrigger inner tube 99 is roughly equivalent to the size of the left outrigger inner tube 117 and the central or main inner tube 23 is substantially larger than either of the outrigger inner tubes 99 and 117. In fact, the main inner tube 23 is more than twice as large as either of the outrigger inner tubes 99 and 117, in the preferred embodiment of the present invention.

The front portion 34 of the elongated member 31 also carries a lateral cross member 129 having mounted thereto a wire frame member 131 such that the bottom portion of a picnic basket, a beverage cooler 133 or the like can be inserted within the hollow interior of the frame member 131 and carried on the top of the front end portion 34 of the elongated support member 31 within easy reach of the person seated in the seat assembly 13 of FIG. 1. At the front distal end 41 of the front portion 34 of the elongated support member 31 is disposed a loop-like tow member 43 for connecting a tow rope or the like for pulling the water craft 11 out of the water or from place to place in the water, as desired.

Lastly, the water craft 11 of the present invention may include an optional motor assembly 15 which includes a power supply or source of potential 119, a vertically distending hollow cylindrical member or shaft 121 so that electrical wires can be placed within the hollow cylindrical member 121 to communicate the source of potential 119 with the electric motor 127 at the opposite end of the shaft 121. The motor 127 drives a conventional propeller 125 for propelling or moving the craft 11 through the water or from place to place. A bracket assembly 123 is mounted on the distal end of the rear end portion 36 of the elongated support member 31 for securing a mid portion of the elongated cylindrical member 121 rotatably thereto. The lateral cross bar 61 is connected rigidly to the cylindrical shaft 121 at its central portion and it has apertures in the opposite end portion 63 for receiving the opposite ends of the cords or cables 55 therein. The cords or cables 55, after exiting the rear guide means 59, crossover one another so that they are connected to opposite ones of the apertures 63 in the ends of the member 61. In this manner, when the steering bar 49 is turned in a clockwise or counterclockwise direction, the shaft 121 and hence the electric motor 127 and propeller 125 are rotated in a corresponding counterclockwise or clockwise direction, respectively, thereby enabling the person sitting in the seat assembly 13 to steer the craft 11 as desired.

Figure 2:
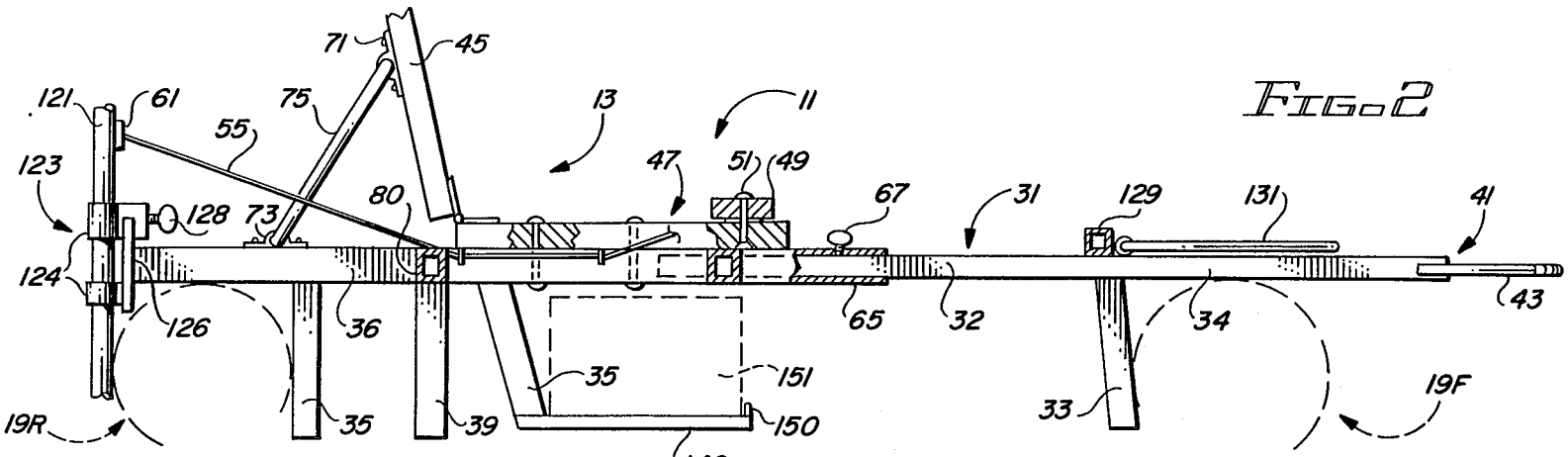
FIG. 2 is a sectional side view of the craft of FIG. 1.

FIG. 2 shows a sectional side view of the water craft apparatus 11 of FIG. 1. In FIG. 2, the elongated support member 31 is shown as having a rear end portion 36, a front end portion 34, and a distal front end portion 41 carrying the tow member 43. The downwardly distending front leg member 33 is shown as being disposed against the front portion 19F of the doughnut-shaped inner tube 23 while the downwardly disposed rear leg member 35 is disposed against the rear end portion 19R of the inner tube 23. The right outwardly distending leg portion 39 is also shown as being connected to the cross support member 80. The seat assembly 13 is shown as including a seat back 45 and a seat bottom 47. A steering means 49 is mounted on the top surface of the seat bottom 47 by centrally disposed pivot pin 51 to enable the steering arm to be turned for guiding the craft through the water.

FIG. 2 also shows that the intermediate or central portion 32 of the elongated support member 31 is operatively received within the hollow interior of the channel member 65 so that the seat assembly 13 can be longitudinally selectively positioned forward and backward along the member 31 and secured in a desired location by means of the fastener device 67. The distal rear end of the end portion 36 of the support member 31 includes a mounting bracket 123. The bracket 123 includes a pair of annular members 124 for operatively receiving this cylindrical member 121 therein, a plate 126 for mounting bracket assembly 123 to the distal end of the elongated member 131 and a fastener or mounting fastener 128 for fixedly securing the members 124 to the distal end of the longitudinal support member 31. The shaft or cylindrical member 121 is adapted to be rotatively received within the annular members 124 and the guide bar 61 can be turned in either direction by the cables or cords 55 rotating the shaft 121 clockwise or counterclockwise for steering the watercraft of the present invention.

FIG. 2 also shows the bracket 71 mounted to the rear of the seat back 45 and the bracket 73 mounted to the top surface of the rear end portion 36 of the elongated support member 31 and the locking bar 75 having its opposite end portions inserted within the socket-like apertures of the brackets 71 and 73 for locking the seat back 45 in an upright position. FIG. 2 further shows that the seat back 45 is connected to the seat bottom 47 by a hinge member 135 so that the seat back can be folded down when the locking bar 75 is removed from the brackets 71 and 73 for storage or transport purposes and raised to the upper position and locked at that position during use by the locking bar 75 being inserted within the apertures or sockets of the brackets 71 and 73.

The central portion 32 of the elongated support member 31 is also shown as carrying a cross support member 129 to which is mounted, as by spring means or the like a wire bracket 131 for positioning a picnic basket, beverage cooler, or the like therein. Lastly, the undercarriage of the frame assembly can include a generally downwardly disposed member 35 carrying a shelf-like member 149 having a forward raised lip 150 adapted to contain a conventional twelve volt battery 151 on the platform or shelf 149 while the lip 150 prevents it from tipping or sliding off of the shelf member 149. The length of the member 35 ensures that the battery 151 is positioned well above the water level.

Figure 3:
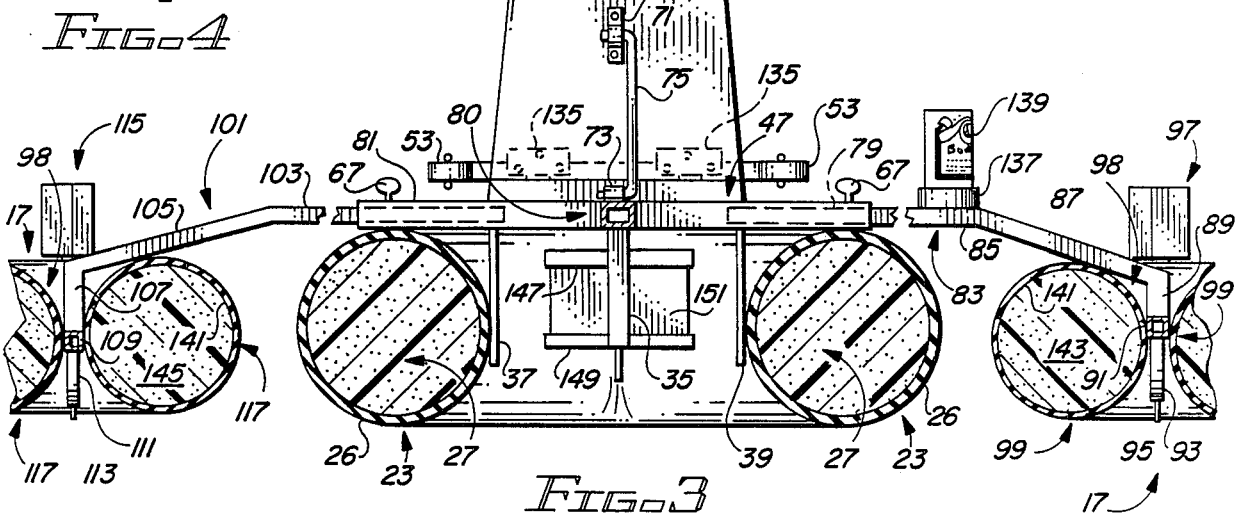
FIG. 3 is a sectional end view of the watercraft of FIG. 1.

FIG. 3 shows a sectional rear view of the water craft apparatus 11 of the present invention. In FIG. 3, the lateral cross support 80 is shown as having a right end portion 79 and a left end portion 81. The lateral cross support member 80 is a generally rectangular member having a generally rectangular hollow channel extending therethrough. The right outrigger assembly 83 is connected to the cross support member 80 with one end of the horizontal portion 85 being inserted within the hollow channel of the right end portion 79 of the cross support member 80 and securing it at a desired position therein with the fastener means 67. The vertical member 89 is connected to the horizontal member 85 by the intermediate downwardly sloped portion 87. The top surface of the horizontal portion 85 is shown as being provided with a retainer 137 for stabley housing a beverage container 139 within easy reach of the person sitting in the seat assembly 13. A right remote speaker assembly 97 is shown as being positioned on the sloped portion 87 of the right outrigger arm assembly 83 and the elongated longitudinal member 91 with the outwardly disposed C-shaped end portions 93 and the tying means 95 are shown as being positioned within the hollow interior 98 of the outrigger inner tubes 99 and 117. The outrigger inner tube 99 is shown as having a hollow central interior bounded by the inner surface 141 which can be filled with a foam material 143, such as polyurethane foam or the like, to add additional buoyancy to the inner tube 99, as conventionally known. Alternatively, the hollow interior of the outrigger inner tube 99 can be filled with a gas such as air so that it is inflatable and can be carried or transported and stored in a deflated condition and then inflated on site for use purposes.

The opposite or left outrigger assembly 101 includes a corresponding horizontal arm portion 103, a sloping arm portion 105, and a vertical arm portion 107. The vertical arm portion 107 is connected to a longitudinal member 109 having a distal end portion equipped with an inverted C-shaped member 111 and a cord 113 such that C-shaped portion is adapted to receive opposite end portions of the inner tube 117 therein while the cord 113 wraps around the exposed portion of the tube so that the tube is stretched on the longitudinal axis defined by the member 109. It will be noted that the hollow interior of the doughnut-shaped left outrigger inner tube 117 is defined by the inner surface 141 and is shown as being filled with air as an alternative to the foam means by the right outrigger inner tube of FIG. 3. Simultaneously, the sloped portion 105 of the left outrigger arm assembly 101 as shown as carrying the second or left remote speaker 115 so that the stereo unit 77 can produce true stereo sound from the spaced apart remote speakers 97 and 115 mounted on the right and left outrigger assemblies 17 respectively.

FIG. 3 also shows the large central doughnut-shaped inner tube 23 as including an inner tube wall 26 and a hollow interior filled with a foam material 27. As previously described, the foam material can be any suitable foam such as polyurethane foam which can add buoyancy and/or stability to the inner tube 23. Similarly, the hollow interior can be filled with air or a similar gas and deflated for transport and storage, and then reinflated at the site of use, as conventionally known. FIG. 3 also shows the position of the downwardly-distending left and right leg members 37 and 39, respectively, bearing against the inside surfaces 25 of the inner tube 23. Positioned between the left and right leg members 37 and 39 is a downwardly-distending support 35 secured to a top support plate 147 and a bottom support plate 149. A conventional twelve volt battery is shown as being positioned between the top plate 47 and the bottom plate 149 and maintained a sufficient distance above the water level for keeping the battery 151 relatively dry. The battery can also be sealed and made waterproof.

FIG. 3 also shows the seat assembly 13 including the seat back 45 and the seat portion 47. The steering bar 49 is shown as being mounted on top of the seat bottom 47 and the ends 53 of the steering bar 49 are shown as including apertures 52 for tying one end of a pair of cables 55 thereto. It can also be seen that the seat back 47 is hingedly connected by hinges 135 to the seat bottom 47 so that the seat back 45 can be folded down over the seat bottom 47 for storage and transport purposes and raised to a use position and locked therein by the locking member 75 having its end portion inserted within the socket-like bracket openings 71 and 73, respectively.

Figure 4:
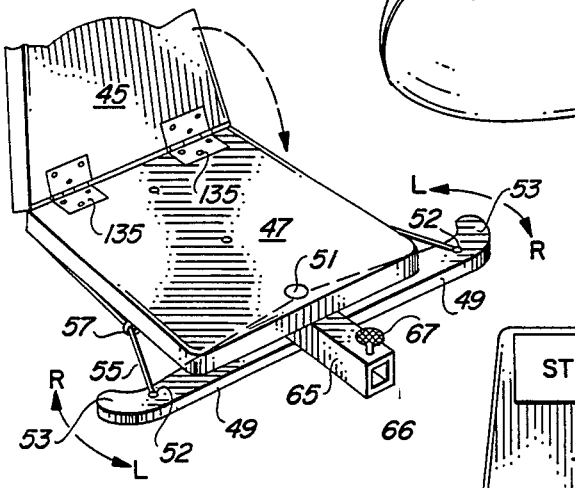
FIG. 4 is a partial perspective view of the seat and steering mechanism of the craft of FIG. 1.

FIG. 4 shows an alternative seat assembly 13 having a seat back 45 and a seat bottom 47. The seat back 45 is connected to the seat bottom 47 via a pair of hinges 135. The difference resides in the fact that the steering bar 149 is pivotally mounted to a central portion of the seat bottom 47 by pivot pin 51, but the seat steering bar member 49 is disposed below the seat bottom 47 and below the channel member 65. The end portions 53 are seen as including aperture means 52 for connecting one end of cords or cables 55 and the cables are then threaded through the eyelets or guide members 57 and 59 to the steering bar 61 where the cables are crossed over each other and have their end portions secured to apertures 63 on opposite ends of steering bar or cross bar 61, as previously described. It can be seen that the rectangular channel member 65 has a generally rectangularly-shaped hollow channel or interior 66 and is provided with a threaded fastening member or wing bolt member which can be rotated to clamp or lock the channel member 65 at a desired position along the central portion 32 of the elongated support member 31.

Figure 5:
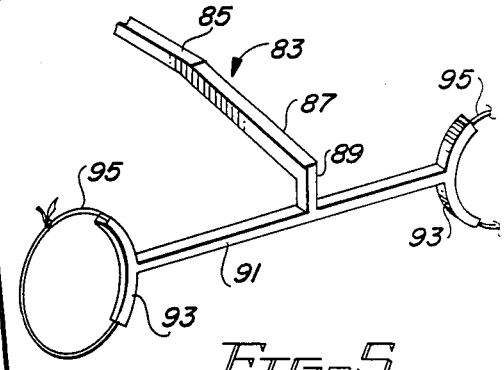
FIG. 5 is a partial schematic view the means for attaching the outrigger tube to the outrigger of the present invention.

FIG. 5 shows a perspective view of the right outrigger arm assembly 83 of the present invention. The assembly 83 is shown as having a horizontal portion 85, an intermediate, downwardly-sloped portion 87, and a vertical end portion 89. The vertical end portion 89 is connected to or integral with the mid-portion of an elongated longitudinal member 91 having an axis generally parallel to the axis of the elongated support member 31 and perpendicular to the axis of the outrigger arm comprising portions 85, 87 and 89. The distal ends of the bar 91 terminate in outwardly curved C-shaped end portions adapted to be disposed against the interior side surface of the outrigger inner tube 99, and the C-shaped portions are provided with tying members 95 for fitting around the exterior of the annular tube 99 for tying it thereto. The length of the bar 91 is greater than the inside diameter of the inner tube 99 so that the outrigger tube 99 is stretched longitudinally along the axis of the member 91.

Figure 6:
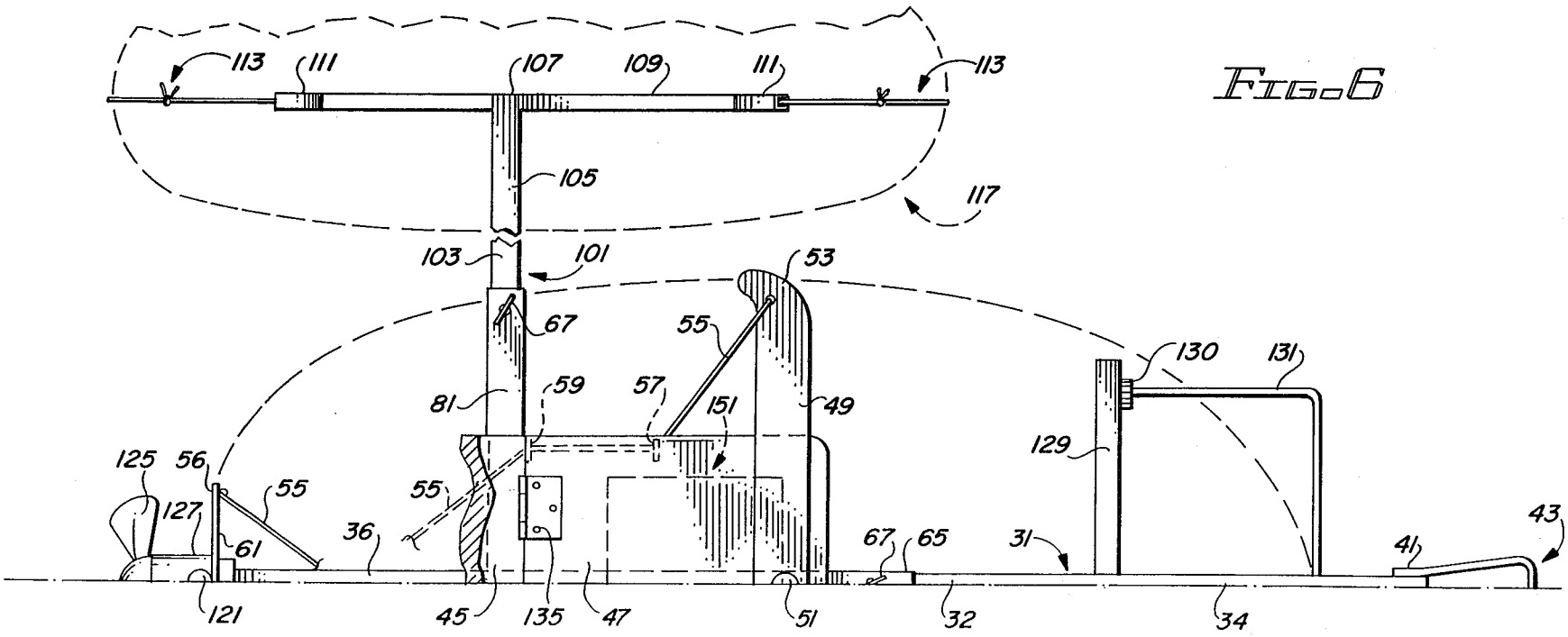
FIG. 6 is a partial top plan view showing one side of the watercraft apparatus of FIG. 1.

FIG. 6 shows a top view of the water craft of FIG. 1. In FIG. 6, the elongated support bar 31 is again shown as having a front end portion 34, an intermediate portion or mid-portion 32, and a rear end portion 36. The front end portion 34 has mounted thereon a cross member 129 which is connected to the wire bracket assembly 131 as previously described, while the distal end portion 41 at the front end portion 34 of the elongated support member 31 terminates in a tow element or tow device 43. The end portion 36 has its distal end connected to bracket assembly 123 of FIG. 2 and the guide cable 55 is seen as being connected to apertures 56 in the ends of the member 61. FIG. 6 also shows the electric motor 127 which drives the propeller 125 and the cylindrical vertical support 121 for the motor 127.

The outrigger assembly shown in FIG. 6 is the left outrigger assembly of FIG. 3 and the arm assembly 101 includes a horizontal portion 103, a sloped portion 105, and a vertical portion 110 which is connected to or integral with a longitudinal member 109 terminating in outwardly curved C-shaped end members 111 adapted to be conformed to the curved inner surface of the left outrigger tube 117. The tying member 113 is shown as being wrapped around the exposed end portions of the tube 117 and back to the C-shaped end portions 111 so that the tube is stretched along the longitudinal axis member 109 and tied securely to the end portions 111 thereof.

Lastly, the seat assembly 13 is shown as including a seat bottom 47 being connected by hinge means 135 to the hinge back 45. The front portion of the seat bottom 47 is connected via a pivot pin 51 to the steering member 49; and the steering member 49 can be rotated in either a clockwise or counterclockwise direction about the pivot pin 51, as desired. An aperture 52 in the end portion 53 of the lateral steering bar or arm 49 is used to connect one end of a cable 55 thereto. The cable is then threaded through a first eyelet or guide member 57 and then through a rear eyelet or guide member 59 and then the opposite ends of the cables 55 are crossed over one another and tied to the aperture 56 at the opposite ends of the steering bar cross member 61 secured to the shaft 121. It can also be seen that the seat bottom 47 is carried on a hollow rectangular channel member 65 so that it can be slid forward or backward on the intermediate portion 32 of the elongated support member 31 and locked at a desired position by the fastener member 67. The lateral cross support member 80 has a left end portion 81 securely connected at its center to the support member 31; and the hollow interior of the left end portion 81 is adapted to operatively receive one end of the horizontal portion 103 of the left outrigger arm assembly 101 therein. The position can then be secured after it is adjusted to a desired length by a similar fastener element 67 carried by the outer end portion 81 of the lateral cross member 80.

It will be understood that while the preferred embodiment of the present invention is shown as utilizing a main flotation device which includes a relatively large, doughnut-shaped inner tube 23, and while the outrigger inner tubes 99 and 117 are illustrated as conventional doughnut-shaped rubber inner tubes, that the flotation means could be a shaped piece of styrofoam material without the actual inner tube itself, or the outrigger flotation devices could be actual inner tubes while the central portion could be a large piece of styrofoam or other floatable material. It will also be understood that the electric motor is optional in the preferred embodiment of the present invention as are the cooler carrier, drink carrier, battery carrier, stereo, and remote stereo speakers.

Those skilled in the art will realize that various modifications, variations, changes, substitutions and alterations can be made in the structure and materials of the present invention without departing from the spirit and scope thereof which is limited only by the appended claims.

I claim:

1. A floatable craft comprising:

(a) a first generally circular floatation means having a top surface and including a central opening therein of first diameter;

(b) second and third generally circular floatation means each having a central opening therein with substantially equal second diameters, the first diameter of said first means being greater than said second diameter;

(c) frame-forming means operatively carried by said first floatation means and including;

i. an elongated, longitudinal support member operably disposed across the central opening of said first floatation means, said support member having first and second opposite end portions with said first end portion being supportively carried on the top surface of diametrically opposing sides of said first floatation means;

ii. front and rear downwardly disposed leg members operatively carried by said first and second end portions of said support member for stretching said first floatation means therebetween;

iii. a first generally horizontal hollow-channel portion secured at its central portion to said elongated support member;

iv. left and right downwardly disposed support legs affixed to said hollow-channel portion and located within the central opening in said first floatation means forward of said rear leg for resisting lateral inward pressure of said first floatation means;

(d) seat means operatively carried by said frame-forming means upon said first floatation means and positioned substantially over the central opening of said first means; and (e) a pair of outrigger means operatively disposed on opposite sides of said frame-forming means for stabilizing said first floatation means and the seat means carried thereon, each of said outrigger means including:

i. a generally horizontal portion having opposing ends with one end adapted to fit within the hollow channel of said first channel portion and for being adjustably positioned and secured therein;

ii. a vertically disposed end portion;

iii. a generally downwardly sloping portion intermediate of the other end of said horizontal portion and said vertical portion;

iv. a longitudinal member having a central portion operatively connected to the vertical end portion and having a length adapted to be operatively disposed within the central opening of one of said second and third floatation means for stretching same in a direction substantially parallel to said elongated member;

v. outwardly facing C-shaped end portions operatively disposed on the opposite sides of said elongated member, the bight of said C-shaped portions being adapted to receive at least a portion of the generally rounded inner tube therein at opposite sides of said second and third floatation means; and vi. means carried by said outwardly facing C-shaped members for tying the adjacent portion of the floatation means thereto.

2. The floatable craft of claim 1 wherein said seat means includes a seat bottom and a seat back, and said seat means further includes hinge means operatively coupling the seat bottom to the seat back for enabling said seat back to be folded down on the seat bottom for storage and transport purposes.

3. The floatable craft of claim 2 wherein said seat means further includes a first socket-like bracket operatively disposed on the rear of said seat back;

a second socket-like bracket operatively carried by said frame forming means;

and an intermediate locking bar having opposite ends adapted to fit into said socket means for locking the seat back in a fixed upright position.

4. A floatable craft comprising:

(a) a first generally circular floatation means having a top surface and including a central opening therein of first diameter;

(b) second and third generally circular floatation means each having a central opening therein with substantially equal second diameters, the first diameter of said first means being greater than said second diameters;

(c) frame-forming means operatively carried by said first floatation means and including an elongated longitudinal support member operably disposed across the central opening of said first floatation means, said support member having first and second opposite end portions with said first end portion being supportively carried on the top surface of diametrically opposite sides of said first floatation means;

(d) seat means operatively carried by said frame-forming means upon said first floatation means and positioned substantially over the central opening of said first means;

(e) a pair of outrigger means operatively disposed on opposite sides of said frame-forming means for stabilizing said first floatation means and the seat means carried thereon, each of said pair of outrigger means including one of said second and third floatation means operatively disposed at the outer end thereof;

(f) bracket means mounted on the rearward one of said opposite end portions of the elongated support member for receiving driving means affixed thereto, said driving means propelling said craft through the water;

(g) steering means for controlling the direction in which said craft is driven including:

i. a crossbar steering member having opposing end portions, said steering member being pivotally mounted on a central portion of said elongated support member;

ii. flexible means operatively carried by the opposing end portions of said crossmember;

iii. guide means for operatively guiding said flexible means therethrough; and (h) driving means affixed to said bracket having an elongated cylindrical shaft extending downwardly into the water; and (i) a cross bar fixedly secured to a central portion of said elongated cylindrical shaft with the opposite ends of said elongated flexible members being crossed over one another and operatively secured to opposite end portions of the cross bar such that rotating said cross bar steering member will rotate the elongated cylindrical shaft of said driving means to thereby control direction of said craft.

* * * * *